United States Patent [19]

Day

[11] 4,184,771

[45] Jan. 22, 1980

[54] CENTRIFUGAL MUD MIXER

[75] Inventor: Roger W. Day, Houston, Tex.

[73] Assignee: Geosource Inc., Houston, Tex.

[21] Appl. No.: 936,643

[22] Filed: Aug. 24, 1978

[51] Int. Cl.[2] ..... B28C 5/06; B01F 3/12; B01F 5/00

[52] U.S. Cl. ..... 366/3; 366/10; 366/15; 366/134; 366/165; 366/181; 366/182; 366/341

[58] Field of Search ..... 366/3, 10, 14, 15, 131, 366/134, 150, 165, 177, 178, 179, 181, 182, 341, 262

[56] References Cited

U.S. PATENT DOCUMENTS

| | | | |
|---|---|---|---|
| 830,543 | 9/1906 | Trump et al. | 366/178 |
| 2,330,875 | 10/1943 | Ellis et al. | 366/150 X |
| 3,185,447 | 5/1965 | Hach | 366/131 |
| 3,294,490 | 12/1966 | Hach | 366/178 X |
| 3,298,669 | 1/1967 | Zingg | 366/177 X |
| 3,741,533 | 6/1973 | Winn, Jr. | 366/178 X |
| 3,957,495 | 10/1960 | Ashbrook | 137/604 |
| 3,976,109 | 8/1976 | Bailey | 366/182 X |
| 3,998,433 | 12/1976 | Iwako | 366/178 |

FOREIGN PATENT DOCUMENTS

| | | | |
|---|---|---|---|
| 1179913 | 10/1964 | Fed. Rep. of Germany | 366/165 |

OTHER PUBLICATIONS

Harvey, C.L. "The Baroid Quik—Mixer", IADC Conference on Valves, Agitators, and Mixers for Surface Mud Systems, Oct. 4–6, 1977. (And advertising Brochure).

Lee, H. A. "Solid Addition Equipment Predicting Satisfactory Hopper Performance", TRW Mission Manufacturing Co. Advertising Material Paper.

*Primary Examiner*—Philip R. Coe

[57] ABSTRACT

An apparatus and method for mixing liquid or drilling mud with solids is disclosed. The apparatus provides first and second concentric housings which are utilized as mixing chambers. An inlet passageway is tangentially connected to the inner housing for feeding a slurry material to be mixed with solids axially fed into the same housing. A discharge port is further provided and connected to an outer housing for tangentially discharging the homogeneous mixture of slurry and solid materials from the outer mixing chamber at high velocities to an elevation above the inlet. The method for mixing includes tangentially feeding the slurry into the mixing chamber, mixing the slurry with solid materials through the use of centrifugal force, shear forces and spill-over from the inner chamber to the outer chamber, and finally tangentially discharging the mixture from the outer chamber.

19 Claims, 3 Drawing Figures

FIG. 1
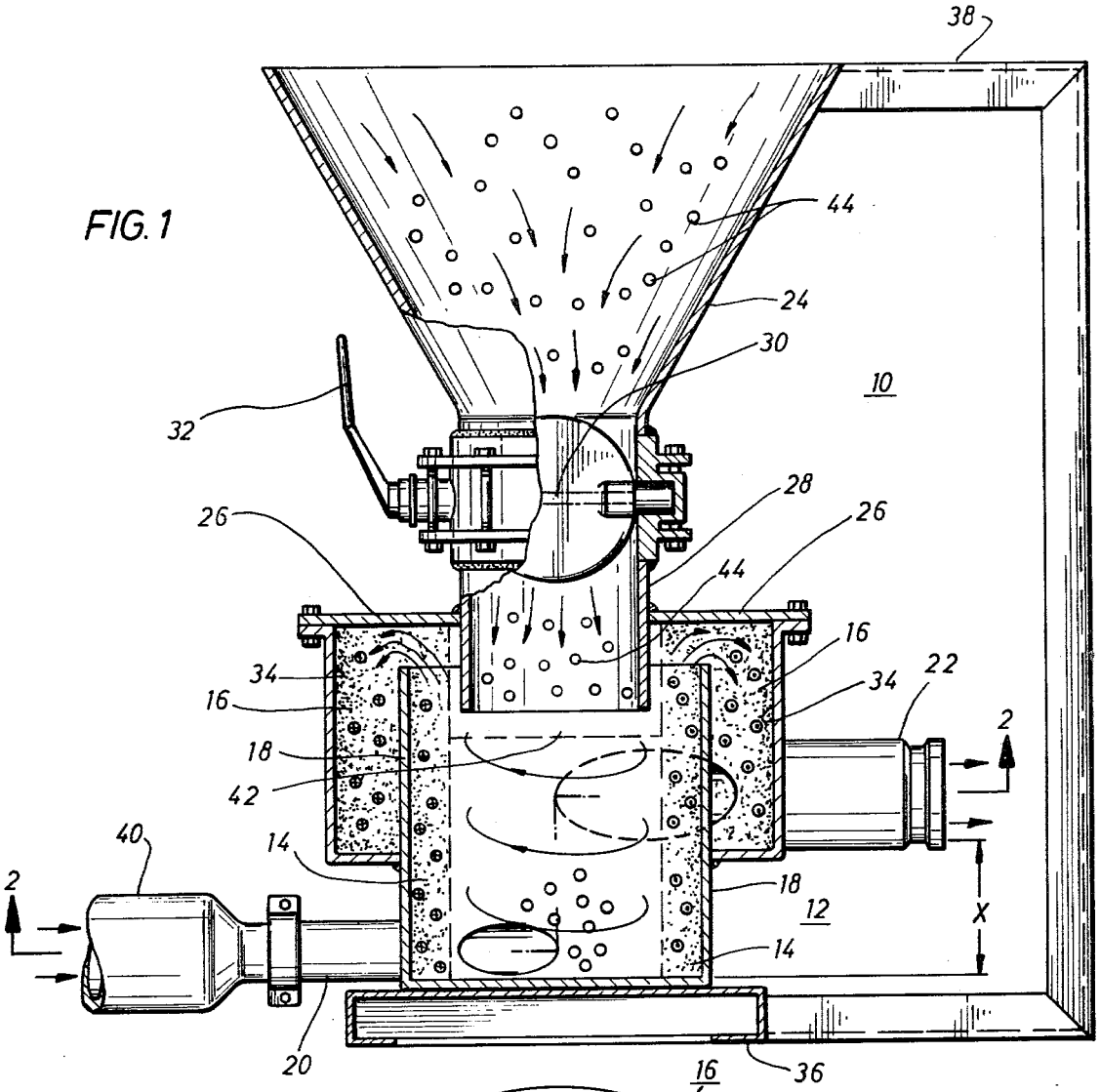
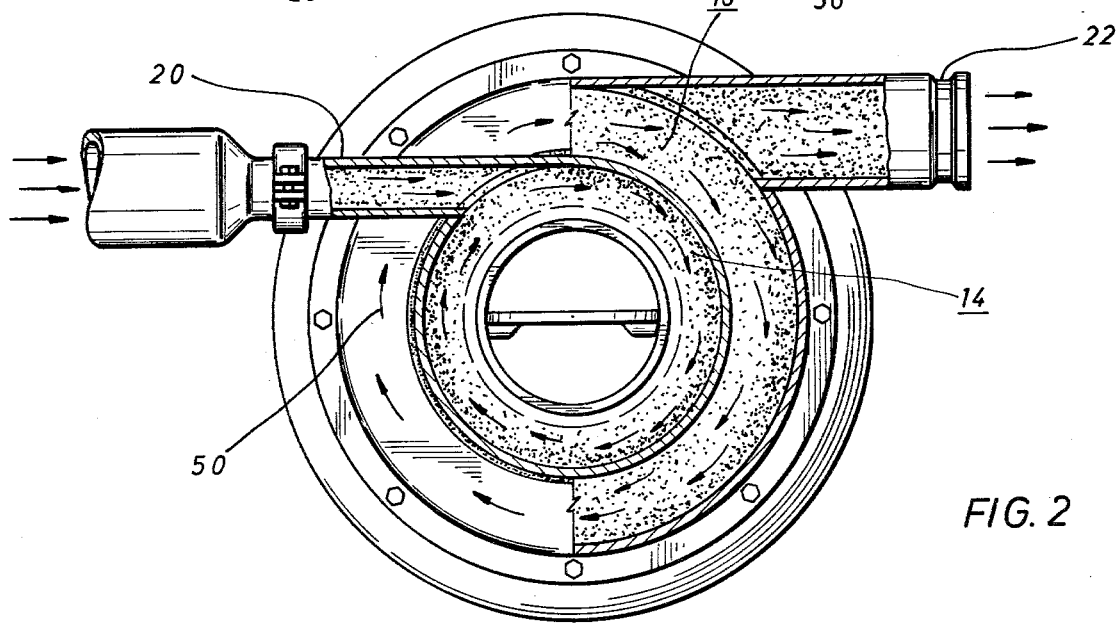
FIG. 2

CENTRIFUGAL MUD MIXER

BACKGROUND OF THE INVENTION

This invention pertains to an apparatus and method for mixing liquid or drilling mud with solid materials and more particularly to a centrifugal mud mixing device utilizing high rotational velocity for obtaining a homogeneous mixture of mud slurry and solid materials.

In drilling for any hydrocarbon products it is necessary to control the hydrostatic head of the drilling mud at the bottom of the drill hole. The drilling mud is used for purposes of preventing geopressured hydrocarbon materials from coming to the surface. At the bottom of the hole surrounding the geopressured hydrocarbon materials are natural gases that are also under pressure, this pressure may be defined as a formation pressure. The hydrostatic head of the drilling mud must be greater than this formation pressure to prevent the drilling mud from being blown out of the hole.

A second problem encountered in drilling for hydrocarbon materials is in bringing cuttings from the drill to the surface of the hole, that is, loose rock and debris cut by the drill bit from the bottom of the hole. A mud slurry is also injected into the hole for purposes of floating or carrying up these cuttings from the bottom of the hole.

For each of the above uses of mud slurry in the drilling operation for hydrocarbon products the density of the mud slurry as well as its viscosity is of great importance. For example, the deeper the drill hole the greater the formation pressure of the hydrocarbons found at the bottom of the hole and therefore the greater the mud slurry density required to maintain the proper hydrostatic head at the bottom of the hole. Overbalancing of the formation pressure by the hydrostatic head at the bottom of the drill hole prevents blow-out from the hole of natural gases and other hydrocarbon products as stated above.

Further, hydrocarbon drilling operations require the use of mud having a viscosity such that when injected into a drill hole will allow cuttings to be carried to the surface. This type of viscous mud slurry is obtained by mixing clay, or bentonite with water. In order to obtain the proper mud density for controlling the hydrostatic head at the bottom of the drill hole a mud slurry mixture is further concentrated with high density materials, having a 2.4 to 4.5 density such as barium sulfate, i.e. barite.

The prior art teaches several methods and devices for controlling the density and viscosity of mud slurry used in hydrocarbon drilling operations. One type of device deals with addition systems, which may be defined as a device connected to a continual flow system for purposes of injecting a second material into the continuous stream. The only actual mixing performed in such an addition system is any mixing that can be obtained from the movement of the flow material in its confined passageway. The addition system may be merely a second passageway connection for a liquid addition, or may be a funnel holding solid materials connected by a sleeve into the continual flow passageway.

As stated above an addition device will not actually perform a mixing operation, however, also taught in the prior art is a device having a solids hopper or funnel connected to a mixing chamber having an inlet passageway for providing a liquid or slurry to be mixed with solid materials. Mixing in this type of apparatus is enhanced by the use of a jet nozzle passageway carrying the mud slurry or liquid material into the chamber. The mud slurry or liquid is jet sprayed horizontally into the chamber as the solid materials are axially dispersed into the mixing chamber. Further mixing is accomplished in this device by attaching a venturi to the discharge port downstream from the jet mixer. The venturi provides reduction and enlargement of the discharge port which causes velocity change in the slurry thus enhancing turbulence before discharge. A distinct disadvantage of this venturi based mud mixing device is that it continually plugs with the solid materials which are axially fed into the mixing chamber and surround the jet spray. Since the vacuum created in the mixing chamber is not sufficient to assist in discharging the solids through the slurry, and the jet spray being only unidirectional cannot pick up all solids surrounding the inlet passageway and solid material build-up results which requires manual cleaning before further use of the device. A further drawback of this type of system is in the capacity which is dependent upon the amount of port size reduction in the venturi. Although the capacity may be enhanced by a decrease in the port size reduction of the venturi, this expansion will detract from the mixing action caused after the reduction.

The prior art further discloses a mixing device utilizing two inlet ports to a annular mixing chamber having an axially extension passageway connected thereto. By applying a fluid into one inlet of the annular chamber tangentially, a high rotational velocity is obtained within the mixing chamber causing a vortex or air core to be formed in the axially extended passageway. A second fluid is interjected by a second inlet port into the mixing chamber axially and mixed with the first fluid by the rotational forces of the first fluid in the mixing chamber. As the mixture moves in the axial extension of the mixing chamber it continues to rotate in the same direction as the fluid in the annular housing. However, as the fluid is dispelled from the axial extension of the mixing chamber into a second chamber, before being discharged through a discharge port, the vortex is destroyed. This causes further turbulence of the fluids for mixing purposes and begins rotation in an opposite direction to that of the fluids in the mixing chamber. Such a device is disclosed in U.S. Pat. No. 2,957,495 by Ashbrook. This Ashbrook device makes no provision for injecting solid materials into the annular mixing chamber. Primarily used for mixing fluid into fluid or gas into fluid, any attempt to mix a solid into a fluid would cause plugging in the device axial extension passageway of the annular chamber and render the device inoperative. Furthermore, high density materials, such as barite for example, not being flowable materials would render such a system as that found in Ashbrook inoperable since a nonflowable material would not be able to pass through the turn in the inlet passageway in the manner disclosed in Ashbrook without proper pumping of the solid.

SUMMARY OF THE INVENTION

In accordance with the present invention a centrifugal mud mixer is provided having an annular chamber for receiving a mud slurry to be mixed with a solid material. The mixing chamber is separated into a first and second section by an inner wall, thereby forming two concentric housings. The first section of the mixing chamber receives the mud slurry from an inlet passageway that is tangential to the chamber. Solid materials, as for example barite, are added to the mixing chamber by way of a funnel, or solids hopper, which has an axial access into the mixing chamber. A discharge port is provided and tangentially connected to the second section of the annular housing for exhausting the homogeneous mixture of solids and slurry or liquid that have spilled over the inner wall into the second section of the annular housing retaining enough kinetic energy to allow exhaustion at an elevation above the inlet passageway.

A method for mixing a mud slurry or liquid with solid materials for use in hydrocarbon drilling operations is also provided including tangentially feeding a mud slurry or liquid into an annular housing resulting in the high rotational velocity of the mud slurry forming a vortex or air core. Solid materials are mixed with the mud slurry or liquid by axially feeding solids such as barite for example into the vortex of the mixing chamber and allowing the centrifugal forces in the chamber to pull the solids through the liquid to the inner wall. Further mixing of the solids is caused by high shearing action provided by the liquid molecules being forced into concentric interfacial paths within the annular chamber. The final mixing occurs when the solid-slurry mixture spills over from the first section of the annular chamber into the second section thus forcing the solid materials once again through the liquid against the surface of the inner wall. The retention of the kinetic energy by the continued rotation in the same direction of the mixture allows for discharging the homogeneous mixture at an elevation greater than the inlet passageway.

BRIEF DESCRIPTION OF THE DRAWINGS

FIG. 1 is a side section view of the mixing device in accordance with the present invention;

FIG. 2 is a partial section of the mixing device of FIG. 1 taken at lines 2—2 of FIG. 1; and, FIG. 3 is a side-section view of the mixing device, showing a plurality of mixing chambers in accordance with the present invention.

DETAILED DESCRIPTION OF THE DRAWING

Figure 3:
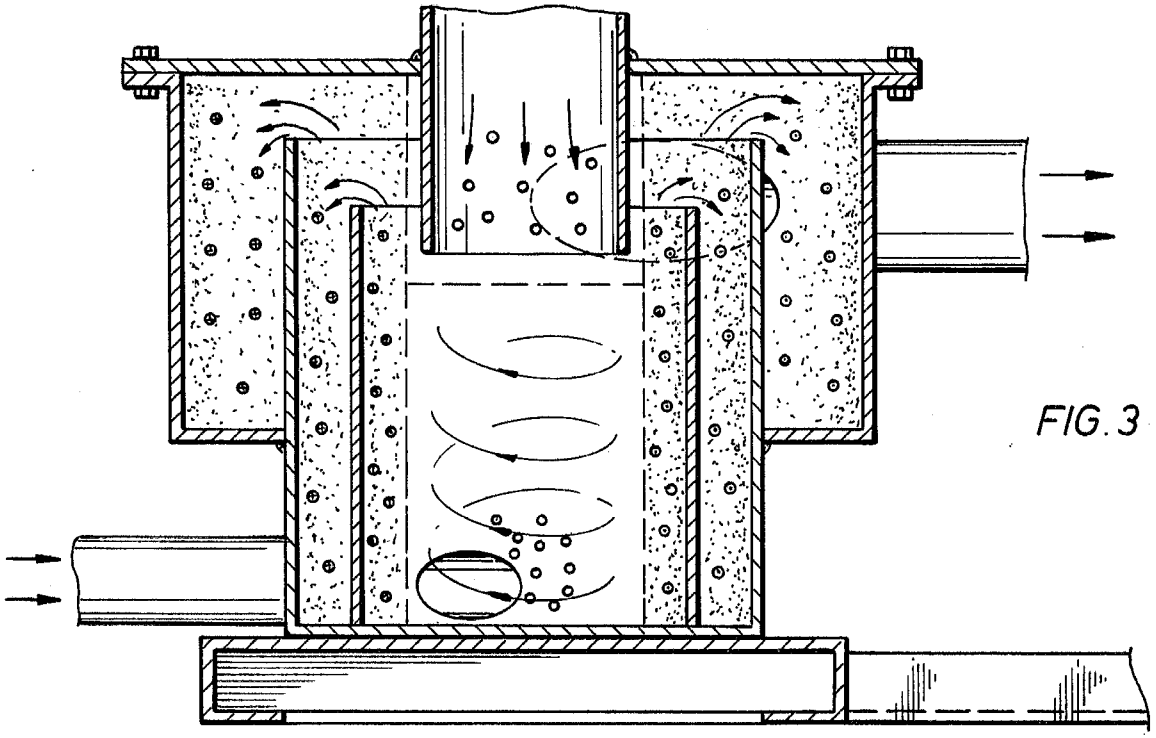

Referring now to the figures and more specifically to FIG. 1 where a centrifugal mud mixing device 10 is illustrated. An annular housing 12 is provided separated into an inner and outer mixing chamber 14 and 16. Mixing chambers 14 and 16 are divided by inner wall 18, and thus located in concentric relationship to one another.

An inlet passageway 20 is tangentially connected to mixing chamber 14 of annular housing 12 to provide a liquid or mud slurry to the mud mixing device 10 at a high rotational velocity. The inlet passageway 20 may be in the form of a metal or plastic tubular structure, for example.

A discharge port 22 is tangentially connected to the mixing chamber 16 of annular housing 12 for exhausting the mud slurry solid material mixture. Discharge port 22 may be located a significant elevational distance X from the inlet port 20.

To facilitate dispersing solid materials into the annular housing 12, and more specifically into mixing chamber 14 for purposes of mixing with the mud slurry from inlet passageway 20 a funnel or solids hopper 24 is provided. Funnel 24 is attached to mixing chamber 14 and held in axial relationship to the same by means of a flange 26 cooperating with a sleeve 28 leading into the mixing chamber 14. In order to close off the mixing chamber from the outside environment at start-up a valve 30 is disposed between the funnel 24 and mixing chamber 14. The valve 30 may be a positive closure type valve, as for example a butterfly valve or a sliding valve. Opening and closing valve 30 may be accomplished by use of a lever or handle 32 functionally cooperating with valve 30.

Due to the abrasive nature of the mud slurry and the high density solids to be combined in a homogeneous mixture within the annular housing 12 a liner 34 covers the inside walls of both inner chamber 14 and outer chamber 16. The liner 34 may be a rigid liner such as ceramic or silicon carbide or may comprise a flexible liner such as rubber or polyurethane, for example.

The annular housing 12 as well as the funnel 24 connected thereto are supported by a skid 36. Further, to enable storing the solid materials before funneling them into the annular chamber 12 for purposes of mixing with the mud slurry mixture an apron 38 is connected to funnel 24 and further supported by skid 36. The "apron" as the term is commonly used in the mud-mixture art, is a planar member capable of supporting bulk dry materials. These materials may be stored in 100 pound bags, for example.

Operationally, the centrifugal mud mixing device 10 receives a mud slurry or liquid from a pressure nozzle 40 connected to the inlet passageway 20 which tangentially feeds the liquid or mud slurry into the annular housing 12 such that the liquid or slurry takes on a high rotational velocity. Dueing the initial operation of the mud mixing device 10 the valve 30 is set with control handle 32 in a closed position thereby preventing the slurry mixture from blowing out the funnel 24. Due to the high rotational velocity of the mud slurry mixture a vortex 42 is formed in the mixing chamber 14. This vortex or air core 42 is maintained throughout the mixing cycle to prevent blowout of the mixture through the funnel 24 and to draw a vacuum to enable proper axial dispersement of the solid materials from funnel or solids hopper 24. The size of vortex 42 is of importance in that it must be greater than the width of the sleeve 28 in order to accomplish its function of preventing blowout of the mud slurry. The maintenance and size of the vortex 42 is accomplished by applying the mud slurry at a pressure of predetermined value which yields a rotational velocity great enough to generate a vortex or air core 42 with sufficient dimension. The calculation for pressure at the inlet passageway 20 to obtain a proper vortex in the annular chamber 14 requires the consideration of the size of the annular chamber 14 as well as the dimension of the sleeve 28, since any backflow from the mixing chamber 14 will by necessity be transmitted through sleeve 28. Therefore, if a smaller annular housing is used the vortex generated by the rotational velocity of the mud slurry will be significantly smaller thereby requiring a corresponding reduction in any sleeve used to axially disperse solids into the mixing chamber.

After the vortex 42 is formed the control handle 32 is used to open valve 30 dispersing solid materials 44 into the mixing chamber 14. The solid materials may be high density solids, such as barium sulfate for example, or lower density solids, such as bentonite, gel, walnut hulls or feathers. The lower density solids would be preferable in obtaining the proper viscosity of mud to enable floating or carrying cuttings of the drilling operation to the top of the drill hole, while the higher density materials are used to suppress the formation pressures at the bottom of the drill hole.

Once the solids 44 are collected at the bottom of the annular mixing chamber 14 the centrifugal force created by the high rotational velocity pulls the solid materials 44 through the mud slurry so as to ultimately circulate within the chamber 14 close to the inner wall 18. Using an inlet pressure of 20 psi may generate a centrigugal force of up to 500 g. for example. Further, high shearing action is provided by the liquid molecules being forced into concentric circular paths of liquid in interfacial relationship. Thus, the solids are further mixed by this shearing force as they are propagated in a rotational manner within the annular housing 14. Due to the high rotational velocity the mud slurry-solid mixture will climb in an upward direction along the surface of inner wall 18 within annular housing 14 and finally spill over inner wall 18 into the outer chamber 16. During the spillover the mixture is inverted. Since the mud slurry-solids mixture continues its rotation in the same direction as within the annular mixing chamber 14 while disposed in annular mixing chamber 16 the same mixing forces take place. Thus, the solid materials 44 are forced radially outward against the outer wall of mixing chamber 16 and mixed by the centrifugal force as well as the shearing action taking place with the concentric liquid paths within the mixing chamber 16. Also, the turbulence of the mixtue at spillover is a further enhancement of the mixing function and provides for a more homogeneous mixture of the mud slurry and solid materials 44.

Although the preferred embodiment of the disclosed mud mixing device provides for two mixing chambers, a plurality of chambers is also contemplated. Each additional concentric chamber would allow further spillover and thus a more homogeneous mixing operation.

Referring now to FIG. 2 where a partial section of the mud mixing device 10 is illustrated, the mud slurry mixture rotates in the same direction 50 in both the inner chamber 14 and the outer chamber 16. By retaining the rotational velocity in the outer chamber 16 in the same direction as the rotation of the mud slurry within the inner chamber 14 the kinetic energy of the mixture is retained and thus enables the discharge of the homogeneous mud slurry-solids material mixture from a tangential discharge port connected to the outer chamber 16 disposed in a elevational relationship above the inlet passageway 20.

The solid materials 44 are pulled into the mixing chamber 14 by the vacuum created by the rotating velocity of the mud slurry and by force of gravity. This vacuum effect permits handling high volumetric rates of solid as for example 7.5 cubic feet per minute of barium sulfate and high mud rates such as 750 gallons per minute.

While the invention has been described and illustrated with respect to specific embodiments it will be understood that other embodiments and modifications in accordance with the spirit and scope of the invention are contemplated. For example, a single annular housing having a tangential inlet port at or near the bottom of the housing and a tangential discharge port at or near the top, may in some cases provide adequate mixing. Further, as illustrated in FIG. 3 the apparatus may have a plurality of mixing chambers with more than one partition wall for enhancing the mixing of the liquid and solid combination. Operationally, the liquid solid mixture would spill over the first partition wall into a second mixing chamber, having the mixture traveling in the same direction as in the first mixing chamber, and finally spilling over a second partition wall further enhancing the mixing action of the apparatus.

What is claimed is:

1. Apparatus for mixing flowable materials with solid material for use in hydrocarbon drilling operations, comprising:

an annular housing having an inner chamber for mixing materials;

an inlet tangentially connected to said inner chamber for feeding a flowable material into said annular housing, causing centrifugal motion and thus creating a vortex in said flowable material;

means operatively associated with said annular housing and axially connected thereto, for feeding solid materials into said flowable material;

means for agitating said flowable materials and said solid materials comprising at least one partition wall disposed within said annular housing such that such flowable materials and said solid materials consecutively spill over said at least one partition wall moving in a radially outward direction to allow for further mixing of said flowable materials with said solid materials; and an outlet tangentially connected to said annular housing, located in spaced parallel relationship above said inlet and outwardly of said partition wall for discharging a mixture of said flowable materials and said solid materials.

2. Apparatus for mixing as set forth in claim 1 wherein said flowable material comprises a mud slurry mixture.

3. Apparatus as set forth in claim 1 wherein said solid materials comprises barium sulfate.

4. An apparatus for mixing as set forth in claim 1 wherein said annular housings' inner chamber is divided into a plurality of mixing chambers separated by said partition walls and disposed in concentric relationship to one another, said inlet intersecting and operatively associated with the innermost of said plurality of mixing chambers and said outlet intersecting and operatively associated with the outermost of said plurality of mixing chambers.

5. Apparatus for mixing as set forth in claim 1 further including a valve disposed between said annular housing and said means for feeding solid materials for controlling the dispersion of solid materials into said flowable materials.

6. Apparatus for mixing as set forth in claim 5 further including valve control means for adjusting the dispersion of said solid materials into said flowable material.

7. An apparatus for mixing as set forth in claim 1 wherein said inlet and outlet comprise tubular passageways.

8. Apparatus as set forth in claim 1 further including storage means connected to said means for feeding solid materials, for storing bulk quantities of said solid materials.

9. An apparatus for mixing as set forth in claim 8 wherein said storage means comprises a storage apron.

10. Apparatus for mixing as set forth in claim 1 further including means for supporting said annular housing.

11. Apparatus for mixing as set forth in claim 1 wherein said solid materials comprise high density material having a density in the range of 2.4 to 4.5.

12. An apparatus for mixing as set forth in claim 1 wherein said solid materials comprise bentonite.

13. Apparatus for mixing as set forth in claim 1 further including a liner disposed within said annular housing for shielding against abrasion.

14. A method for mixing flowable materials with solid materials for use in hydrocarbon drilling operations comprising the steps of:

tangentially feeding a flowable material into an annular housing having a plurality of inner chambers for mixing so as to create a centrifugal motion in said flowable material resulting in forming a vortex in said flowable material;

axially feeding solid materials into said vortex within said annular housing for obtaining a high density mixture;

mixing said solid materials with said flowable materials by centrifugal motion propogating aid solid materials through said flowable materials in a radially outward direction;

agitating said mixture of said flowable and solid materials by spilling said mixture from the innermost chamber of said plurality of inner chambers into consecutive adjacent chambers moving in a radially outward direction while retaining the rotational velocity of said mixture in the same direction of rotation throughout said annular housing; and tangentially discharging said mixture from said annular housing.

15. An apparatus for mixing flowable materials with solid materials as set forth in claim 1 wherein said means for agitating comprises a plurality of partition walls disposed within said annular housing such that said flowable materials and said solid materials consecutively spill over each of said plurality of partition walls moving in a radially outward direction to allow for further mixing of said flowable materials with said solid materials.

16. An apparatus for mixing as set forth in claim 1 wherein said means for feeding solid materials comprises a funnel.

17. A mixing apparatus comprising:

a housing having an inner chamber for mixing materials;

an inlet tangentially connected to said inner chamber for feeding a flowable material into said housing, causing centrifugal motion and thus creating a vortex in said flowable material;

means operatively associated with said housing and axially connected thereto, for feeding solid materials into said flowable materials;

means for agitating said flowable materials and said solid materials comprising at least one partition wall disposed within said housing, such that said flowable materials and said solid materials consecutively spill over said at least one partition wall moving in a radially outward direction to allow for further mixing of said flowable materials with said solid materials; and an outlet tangentially connected to said housing, located in spaced parallel relationship above said inlet and outwardly of said at least one partition wall for discharging a mixture of said flowable materials and said solid materials.

18. A mixing apparatus as set forth in claim 17 wherein said means for agitating comprises a plurality of partition walls disposed within said housing such that said flowable material and said solid materials consecutively spill over each of said plurality of partition walls moving in a radially outward direction to allow for further mixing of said flowable materials with said solid materials.

19. A mixing apparatus as set forth in claim 19 wherein said housings' inner chamber is divided into a plurality of mixing chambers separated by a plurality of partition walls and disposed in concentric relationship to one another, said inlet intersecting and operatively associated with the innermost of said plurality of mixing chambers and said outlet intersecting and operatively associated with the outermost of said plurality of mixing chambers.

* * * * *

UNITED STATES PATENT AND TRADEMARK OFFICE

CERTIFICATE OF CORRECTION

PATENT NO. : 4,184,771

DATED : January 22, 1980

INVENTOR(S) : Roger W. Day

It is certified that error appears in the above-identified patent and that said Letters Patent are hereby corrected as shown below:

Column 4, line 32, delete "Dueing" and insert --During--.

Column 7, line 18, delete "aid" and insert --said--.

Column 8, line 32, delete "19" and insert --17--.

Signed and Sealed this

*Twenty-fourth* Day of *June 1980*

[SEAL]

*Attest:*

SIDNEY A. DIAMOND

*Attesting Officer*

*Commissioner of Patents and Trademarks*